US007172444B1

(12) United States Patent
Huang et al.

(10) Patent No.: US 7,172,444 B1
(45) Date of Patent: Feb. 6, 2007

(54) HARD DRIVE CONTACT PIN CONNECTOR DEVICE

(76) Inventors: Jui-Shu Huang, No. 203, Sec. 1, Renhe Rd., Dasi Township, Taoyuan County (TW); Chu-Wen Tai, No. 17-1, Sinsing Rd., Beitun District, Taichung City (TW)

( * ) Notice: Subject to any disclaimer, the term of this patent is extended or adjusted under 35 U.S.C. 154(b) by 0 days.

(21) Appl. No.: 11/190,905

(22) Filed: Jul. 28, 2005

(51) Int. Cl.
*H01R 13/15* (2006.01)

(52) U.S. Cl. ..... 439/260; 439/188

(58) Field of Classification Search ..... 439/188, 439/259; 200/51.09; 438/260
See application file for complete search history.

(56) References Cited

U.S. PATENT DOCUMENTS 3,789,345 A * 1/1974 Reimer et al. ..... 439/630
4,436,792 A * 3/1984 Tomino et al. ..... 429/1
4,449,775 A * 5/1984 de Pommery et al. ..... 439/373
4,560,222 A * 12/1985 Dambach ..... 439/373
5,086,284 A * 2/1992 Mouissie ..... 335/205
5,185,692 A * 2/1993 Smith ..... 361/683
5,381,043 A * 1/1995 Kohiyama et al. ..... 307/116
5,928,020 A * 7/1999 Bishop et al. ..... 439/188
6,679,716 B2 * 1/2004 Nakagawa et al. ..... 439/267
6,770,986 B2 * 8/2004 Nagao et al. ..... 307/326
6,953,350 B2 * 10/2005 Shiu ..... 439/79

* cited by examiner

*Primary Examiner*—Neil Abrams
(74) *Attorney, Agent, or Firm*—Rosenberg, Klein & Lee

(57) ABSTRACT

A connecting device for insertion into a slot of a hard drive (5) and having internal circuit closing, the device having a front substrate (1) with slots (12), separated by rails (123). There are metal spring blades (2) located in the slots (12) and the front substrate (1) has guide slots (122). The device also has a movably supported push block (3) with portions (31) for being inserted into the slots (12) with guide blocks (33) to be received in the guide slots (122) in the front substrate (1) and having contact spring blades (35). There is a back substrate (4) coupled to the front substrate (1), the substrate assembly forming a space for movably receiving the push block (3). Insertion of the connecting device into the hard drive slot causes the push block 3 to move rearwardly against bias springs (45) whereby contact spring blades (35) are moved along a cam surface (100) in the front substrate (1) and pressed upwardly towards a pin contact support (51) within the hard drive slot and simultaneously are moved into conductive engagement with front portions (21) of the metal spring blades (2).

9 Claims, 4 Drawing Sheets

HARD DRIVE CONTACT PIN CONNECTOR DEVICE

BACKGROUND OF THE INVENTION

1. Field of the Invention

The present invention is related to a hard drive pin connecting device, and more particularly, to a hard drive pin connecting device using point contact method to connect hard drive pins to prevent pins from abrasion caused by plugging and pulling.

2. Description of the Prior Art

Basically there are two kinds of hard drives, PATA drives (or so-called IDE drives) and SATA drives, currently in the market. The transfer rate of the traditional PATA drives is much slower than that of SATA drives, adding that the price of SATA drives is almost the same as that of PATA drives, therefore, consumers tend to choose SATA drives over the traditional PATA drives. Although IDE interface is still by far the dominant spec of hard drives, as SATA emerging to be the mainstream spec for the next generation hard drives, hard drive (HD) manufacturers will aggressively pursuit SATA hard drives for the market. While SATA hard drive provides better transfer rate, it also has thinner and longer cable than that of IDE drive. According to spec, the cable of SATA hard drive is able to reach 100 cm, much longer than the limited 45 cm of PATA hard drive, therefore, the cabling inside PC case will be better organized than before. Furthermore, SATA hard drive supports hot swappable capability, making it a good candidate for externally connected hard drive without additional adapter.

However, currently the pins of SATA hard drive are connected to a cable of the SATA hard drive through a connecting device based on slots, after a plurality times of plugging and pulling movements, the pins of SATA could be worn away to cause weak conductivity, which could severely affect the operation of data storage and processing. The inventor of this invention has proposed a few method and put them in practice, finally develops a new connecting device to provide good contact without damaging the hard drive pins and to exploit the hot swappable capability of SATA drives.

Therefore, the present invention is to overcome several shortcomings mentioned above.

In view of the above-described deficiency of prior-art connecting devices, after years of constant effort in research, the inventor of this invention has consequently developed and proposed a hard drive pin connecting device.

SUMMARY OF THE INVENTION

It is an object of the present invention to provide a hard drive pin connecting device, wherein the hard drive pin connecting device comprises a push block combining contact spring blades. When the push block is forced to slide backwards, a bending part of each contact spring blade makes contact with the retaining compartment of the front substrate, further sliding will cause a front end of each contact spring blade slowly moving upwards to make point contact and electrically couple with a pin component of the hard drive to prevent pins from abrasion caused by long-term plugging and pulling movements.

It is another object of the present invention to provide a hard drive pin connecting device which has simple structure, low cost and is easy to manufacture.

The hard drive pin connecting device comprises a front substrate, a push block, a few sets of metal spring blades and a back substrate; wherein the front substrate having a tab on each side of it and a first hole disposed on each tab, and two slots set up at the front substrate, a guide slot set up at one side of each slot, a guide compartment formed on top of and below two slots respectively, and a plurality of protruding blocks set up suitably at an upper edge of a back end of the front substrate; a few sets of metal spring blades being disposed in a order for inserting inside two slots, and a push block being inserted into two slots, the push block comprising two block partitions and a connecting plate, a guide block formed at one side of each block partition, each guide block being inserted into each one of two guide slots of the front substrate, the connecting plate being placed between two guide compartments, and a plurality of guide posts and positioning plates being disposed at a back end of the push block, a plurality of contact spring blades being disposed at a lower end of each one of two block partitions; a back substrate comprising a tab slot disposed at each side of it and a second hole set up on each tab slot, a slot opening set up at a front end of the back substrate and a plurality of guide holes, positioning holes and fillisters set up at an upper edge of the slot opening, and a spring disposed in each guide hole; each tab slot of the back substrate coupling with each tab of the front substrate, with each hole of the front substrate being locked correspondingly to each hole of the back substrate through a locking member to form the hard drive pin connecting device.

Through the combination of above mentioned components, the pin component of the hard drive is connected by point contact method to prevent pins from abrasion caused by long-term plugging and pulling movements. Furthermore, it is more convenient for users.

These features and advantages of the present invention will be fully understood and appreciated from the following detailed description of the accompanying Drawings.

DETAILED DESCRIPTION OF THE PREFERRED EMBODIMENT

Figure 1:
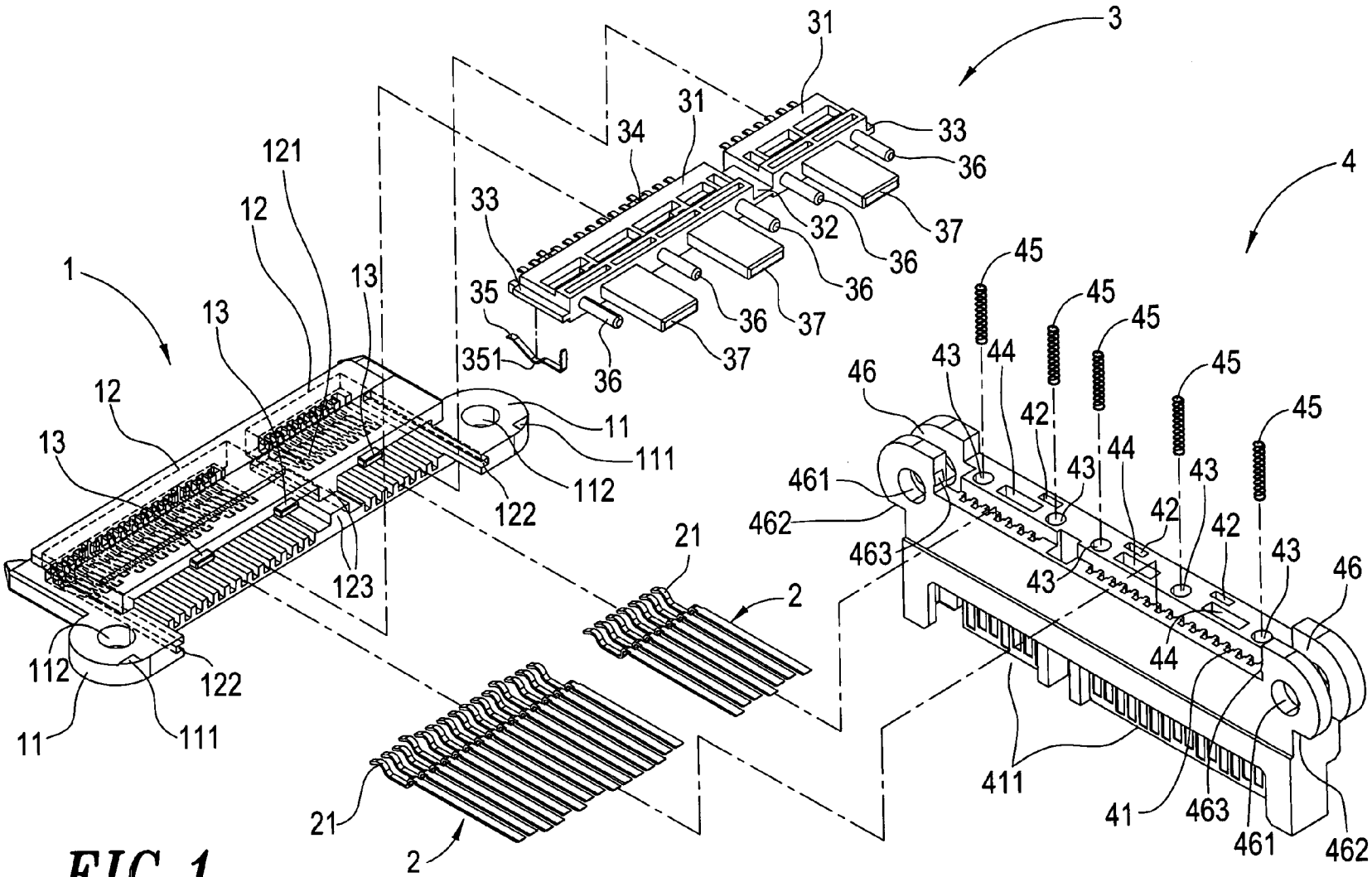
FIG. 1 schematically illustrates a 3D perspective view of the hard drive pin connecting device in the present invention.
Figure 2:
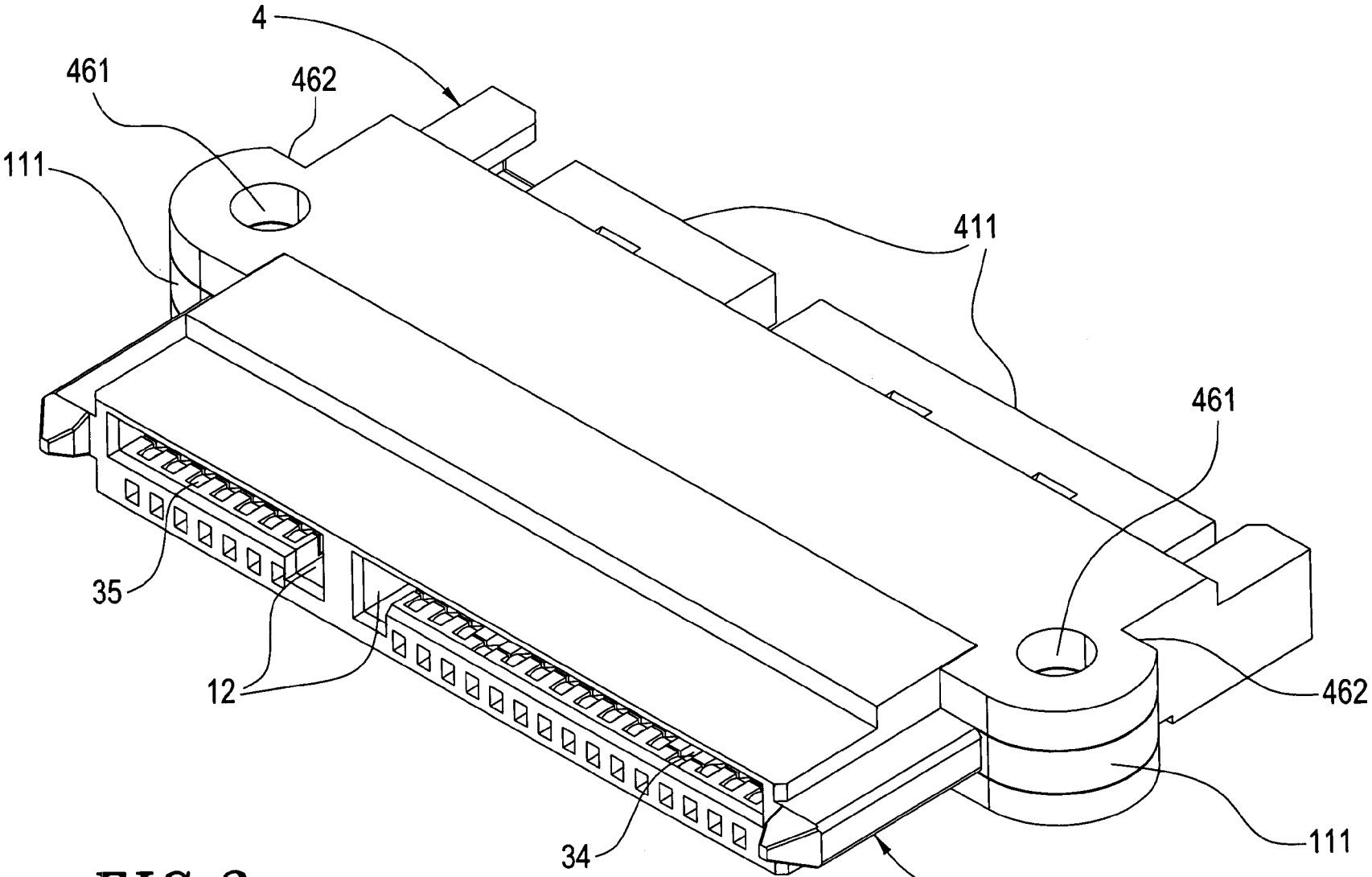
FIG. 2 schematically illustrates a 3D combinatorial view of the hard drive pin connecting device in the present invention.

Please refer to FIG. 1 and FIG. 2, which illustrate the hard drive pin connecting device of the present invention, the device mainly comprises:

A front substrate 1, front substrate 1 having a tab 11 on each side of it and a hole 112 disposed on each tab, and a fastener block 111 disposed on an upper end of each tab 11, and two slots 12 set up at front substrate 1 and linked to each other to form a space, and a plurality of retaining compartments 121 suitably disposed inside two slots 12, a guide slot 122 set up at one side of each slot 12, a guide rail 123 formed on top of and below two slots 12 respectively, and a plurality of protruding blocks 13 set up suitably at the back end of front substrate 1.

A few sets of metal spring blades 2, each metal spring blade 2 having a protruding part 21 bended suitably on the front end; sets of metal spring blades 2 being disposed in a order for inserting inside two slots 12;

A push block 3, the push block 3 comprising two block portions 31 and a connecting plate 32, a guide block 33 formed at one side of each block portions 31, the two guide blocks 33 being disposed correspondingly to guide slots 122 of front substrate 1, a plurality of open slots 34 set up at a lower end of each block portion 31 with a contact spring blade 35 suitably connected to each open slot 34 and disposed therein, contact spring blade 35 having a bending part 351 suitably formed therein, bending part 351 located within retaining compartments 121 of front substrate 1, furthermore, a plurality of guide posts 36 formed in a back end of two block portions 31, and positioning plates 37 formed between each guide posts 36, push block 3 being guided into two guide slots 122 of front substrate 1 through guide blocks 33 on the sides, connecting plate 32 being placed between upper and lower guide rail 123; contact spring blade 35 is made of a conducting material.

A back substrate 4, the back substrate 4 having a slot opening 41 set up in a front end and two pins 411 extending backwards from slot opening 41, a plurality of guide holes 43 set up at an upper end of slot opening 41, a spring 45 inserted inside each guide hole 43 and a positioning hole 44 set up between each guide hole 43, and a plurality of fillisters 42 disposed in an upper edge of a front end of the back substrate, furthermore, a tab slot 46 disposed at each side of back substrate 4 and a hole 461 set up on each tab slot 46, hole 461 corresponding to hole 112 of each tab 11 of front substrate 1, a pawl 462 formed at a lower edge of each tab slot 46, and a protruding block 463 set up inside each tab slot 46; each protruding block 462 tightly holding front substrate 1 and back substrate 4 together when front substrate 1 coupling to back substrate 4; each tab slot 46 of back substrate 4 being coupled to each tab 11 of front substrate 1, allowing each guide hole 43 of back substrate 4 to be coupled correspondingly to each guide post 36 of push block 3 and each spring 45 in each guide hole 43 to be held against each guide post 36, each positioning hole 44 of back substrate 4 corresponding to each positioning plate 37 of push block 3, allowing push block 3 to move forwards and backwards inside back substrate; sets of metal spring blades 2 being inserted inside slot opening 4, when front substrate 1 being coupled and fixed to back substrate 4, each fastener block 111 of two tabs 11 of front substrate 1 buckling up with each pawl 462 of two tab slots 46 of back substrate 4 to hold front substrate 1 and back substrate 4 together more firmly. When front substrate 1 and back substrate 4 combining to form one unit, it is viable to use a locking member to lock holes 112 of front substrate 1 and holes 461 of back substrate 4, the locking member can be a screw or other fixtures.

The above-mentioned components are assembled to form the hard drive pin connecting device.

Figure 3A:
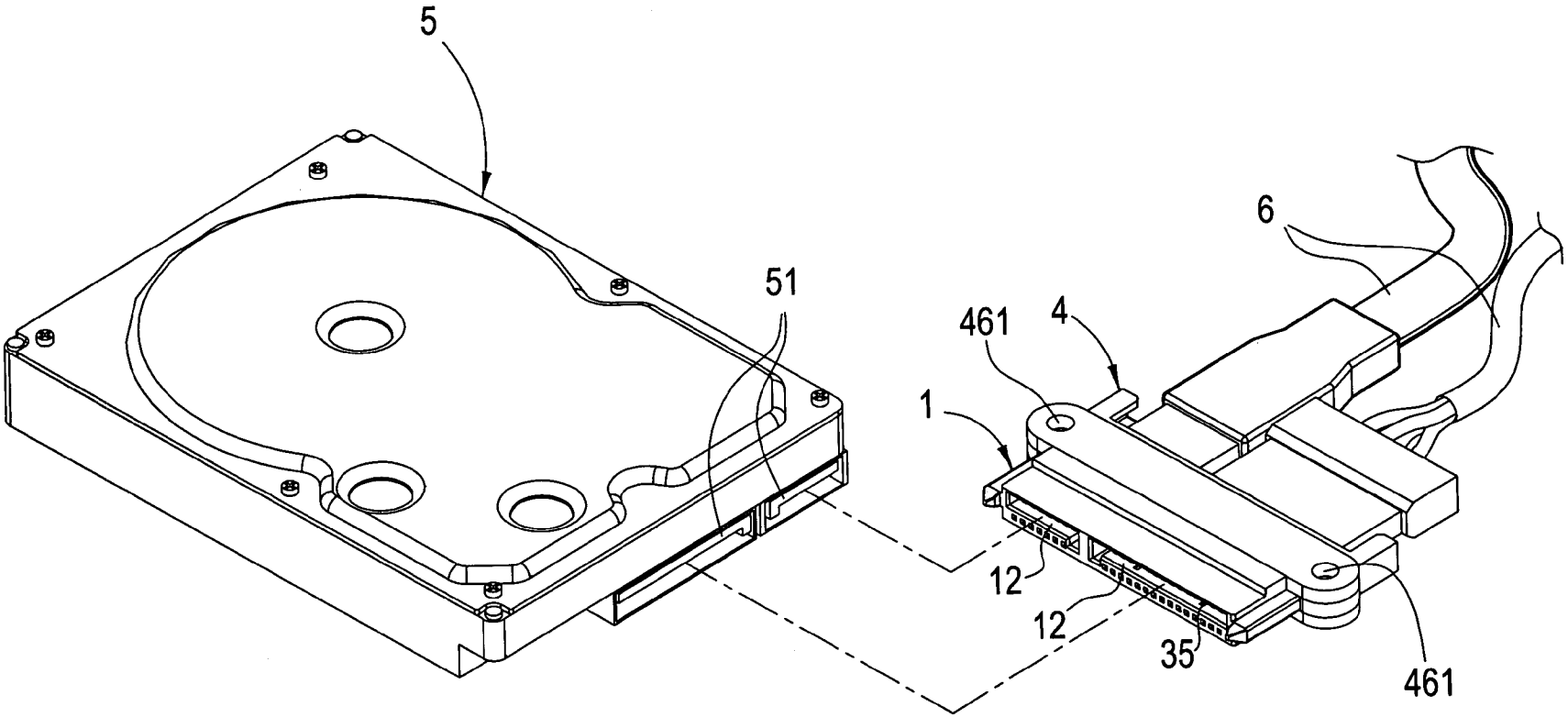
FIGS. 3 A, B and C schematically illustrate connection diagrams of the hard drive pin connecting device in the present invention.
Figure 3B:
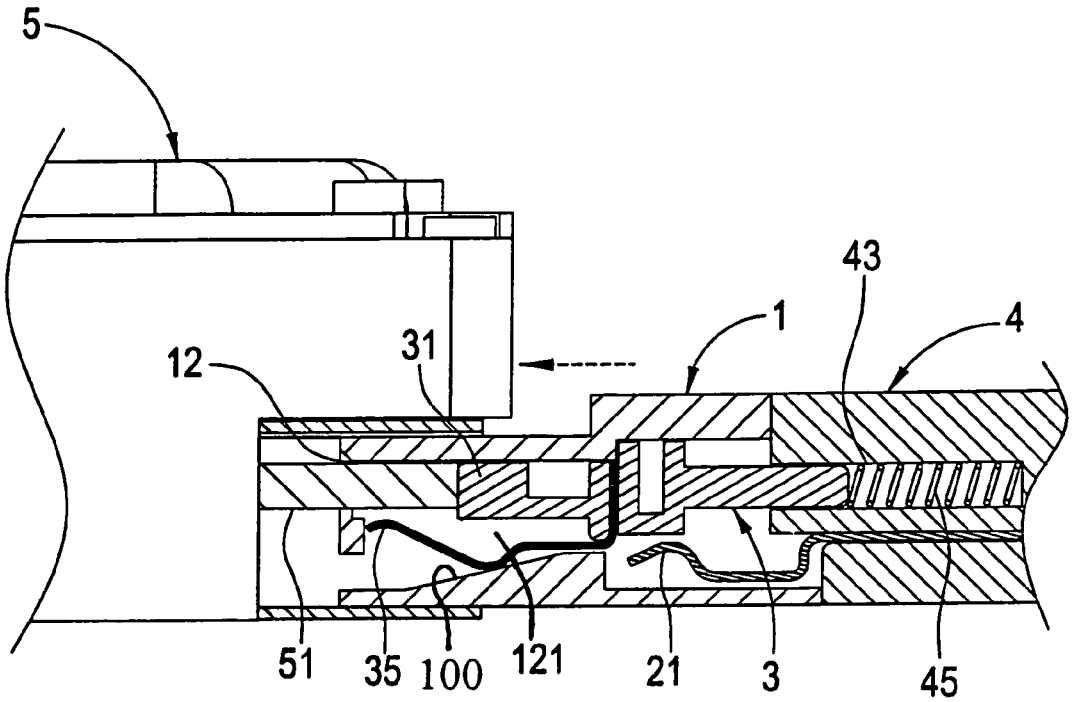
Figure 3C:
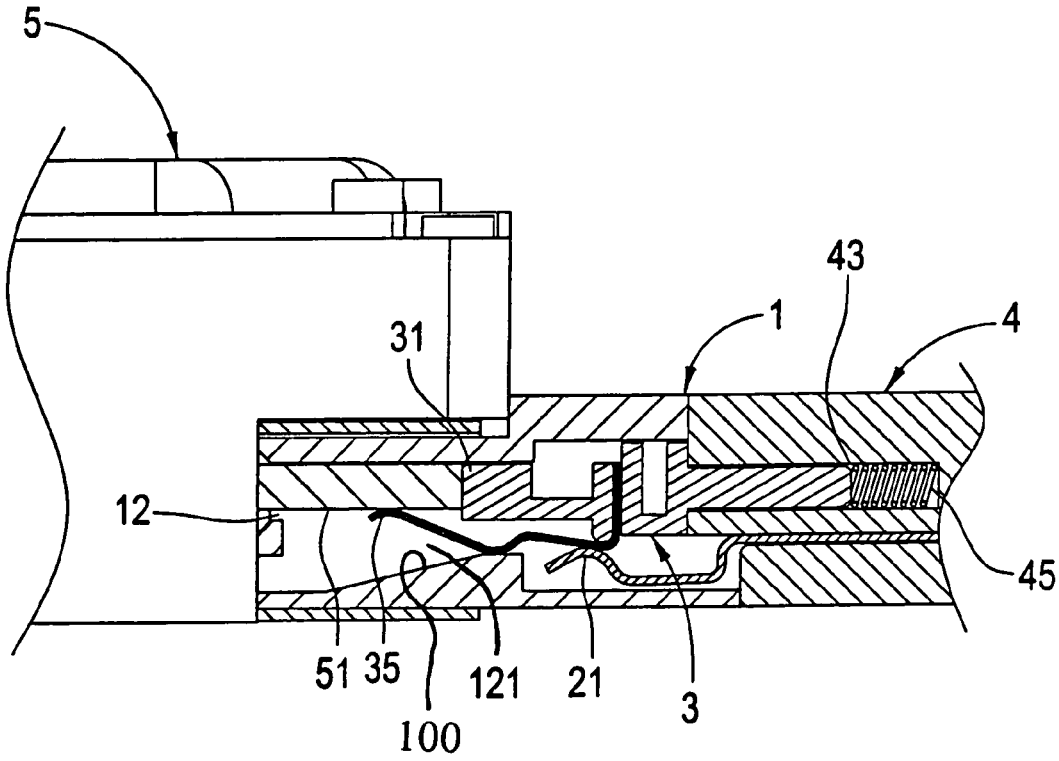

FIGS. 3 A, B and C schematically illustrate connection diagrams of the hard drive pin connecting device in the present invention. The two slots 12 of front substrate 1 are plugged in and electrically coupled with pin component 51 of hard drive 5 (e.g. a SATA hard drive) and two cables 6 are plugged in pin 411 respectively, with the other ends of cables connecting to a PC host (not shown in figures) to enable the hard drive. When hard drive 5 is plugged in, pin component 51 of hard drive 5 pushes block partition 31 of push block 3 to cause push block 3 to slide backwards, and guide post 36 and positioning plate 37 in the back end of push block 3 are pushed concurrently and guided into back substrate 4. Meanwhile, the back end of contact spring blade 35 of push block 3 makes contact with protruding part 21 of metal spring blade 2 first, when push block sliding further backwards, bending part 351 of contact spring blade 35 of push block 3 will slide along a cam surface 100 within retaining compartment 121 of front substrate 1 to cause the front end of contact spring blade 35 to move upwards to be electrically coupled to pin component 51 of hard drive 5. When hard drive 5 is pulled out, the resilience of spring 45 forces guide post 36 of push block 3 to drive push block 3 to slide forwards, the back end of contact spring blade 35 of push block 3 separates from protruding part 21 of metal spring blade 2 and contact spring blade 35 are not held against retaining compartment 121, therefore, the front end of contact spring blade 35 moves downwards to separate from pin component 51. Meanwhile, metal spring blade 2 separates from pin component 51 of hard drive 5 to be disconnected, waiting for hard drive 5 to connect again.

The above-mentioned connection method can provide good conductivity and prevent damage to the contact plane of pin component 51 of hard drive 5 and provide hot swappable capability as well. The connecting device is available for externally connected type of products, or to work with hard drive adapter cases.

The present invention provides a hard drive pin connecting device, which compared with other prior art techniques, is advantageous in:

The present invention provides a hard drive pin connecting device, wherein the hard drive pin connecting device comprises a push block combining contact spring blades. The push block drives a front end of each contact spring blade to move upwards and downwards to make point contact and electrically couple with a pin component of the hard drive to prevent pins from abrasion caused by long-term plugging and pulling movements.

The present invention provides a hard drive pin connecting device which has simple structure, low cost and is easy to manufacture.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

The invention claimed is:

1. A hard drive contact pin connector device comprising:

a front substrate, said front substrate having a tab on each side and a first hole disposed on each said tab, and a fastener block disposed on an upper end of each tab, and two slots set up at said front substrate and linked to each other to define a space, and a plurality of retaining compartments suitably disposed inside said two slots, a guide slot set up at one side of each slot, a guide rail formed on top of and below said two slots respectively, and a plurality of protruding blocks set up suitably at a back end of said front substrate;

a few sets of metal spring blades, each metal spring blade having a protruding part bended suitably thereon; said sets of metal spring blades being disposed in a order for inserting inside said two slots;

a push block, said push block comprising two block portions and a connecting plate, a guide block formed at one side of each block portion, and a plurality of open slots set up at a lower end of each block portion with a contact spring blade suitably connected to each open slot and disposed therein, said contact spring blade having a bending part suitably formed in the middle, said bending part located within said retaining compartments of said front substrate, furthermore, a plurality of guide posts and positioning plates formed in a back end of said push block, said guide block having its block portions being guided between said two slots of said front substrate respectively, said connecting plate being placed between two guide slots, said push block being inserted into said slots of said front substrate, said guide blocks being received in said guide slots;

a back substrate, said back substrate having a slot opening set up in a front end and two pins extending backwards from said slot opening, a plurality of guide holes set up at an upper end of said slot opening, a spring inserted inside each guide hole and a positioning hole set up between each guide hole, and a plurality of fillisters disposed in an upper edge of a front end of said back substrate, furthermore, a tab slot disposed at each side of back substrate and a second hole set up on each tab slot, said second hole corresponded to said first hole of each tab of said front substrate, a pawl formed at a lower edge of each tab slot, and a protruding block set up inside each tab slot; each tab slot of said back substrate being coupled to each tab of said front substrate, allowing each guide hole of said back substrate to be coupled correspondingly to each guide post of said push block and each spring in each guide hole to be held against each guide post, each positioning hole of said back substrate corresponding to each positioning plate of said push block, and said sets of metal spring blades being inserted inside said slot opening, when said front substrate being coupled and fixed to said back substrate, each fastener block of two tabs of said front substrate buckling up with each pawl of two tab slots of said back substrate, to let said front and back substrates to form one unit; and said front substrate, said sets of metal spring blades, said push block, said back substrate being coupled together to form said hard drive pin connecting device.

2. The hard drive pin connecting device of claim 1, wherein said push block is inserted into guide slots of said slots of said front substrate through guide blocks and said connecting plate.

3. The hard drive pin connecting device of claim 1, wherein said sets of contact spring blades are made of a conducting material.

4. The hard drive pin connecting device of claim 1, wherein said push block being forced to slide to a fixed position, a back end of each contact spring blade of said push block making contact with each protruding part of said sets of metal spring blade, and a front end of each contact spring blade slowly moving upwards to make contact and to electrically couple with a pin component of a hard drive.

5. The hard drive pin connecting device of claim 1, wherein each guide post of said push block is capable of moving forwards and backwards inside each guide hole of said back substrate.

6. The hard drive pin connecting device of claim 1, wherein each positioning plate of said push block is capable of moving forwards and backwards inside each positioning hole of said back substrate.

7. The hard drive pin connecting device of claim 1, wherein each protruding block inside two tab slots tightly holds said front and back substrate together when said front substrate coupling to said back substrate.

8. The hard drive pin connecting device of claim 1, wherein each hole of said front substrate being locked correspondingly to each hole of said back substrate through a locking member.

9. The hard drive pin connecting device of claim 8, wherein said locking member is a screw or other fixtures.

* * * * *